United States Patent [19]

Mazelsky

[11] Patent Number: 4,757,742

[45] Date of Patent: Jul. 19, 1988

[54] COMPOSITE BALLISTIC ARMOR SYSTEM

[75] Inventor: Bernard Mazelsky, West Covina, Calif.

[73] Assignee: Ara, Inc., City of Industry, Calif.

[21] Appl. No.: 654,097

[22] Filed: Aug. 23, 1984

Related U.S. Application Data

[63] Continuation-in-part of Ser. No. 424,130, Sep. 27, 1982, abandoned.

[51] Int. Cl.[4] ..... F41H 5/04

[52] U.S. Cl. ..... 89/36.02; 109/79; 109/82

[58] Field of Search ..... 52/417, 465, 469; 89/36.02, 36.08, 36.11, 36.12; 109/10, 78, 79, 80, 81, 82, 83, 84, 85; 114/9, 10, 11, 12, 13, 14; 428/34, 911

[56] References Cited

U.S. PATENT DOCUMENTS

| | | | |
|---|---|---|---|
| 316,250 | 4/1885 | Douglas | 109/79 |
| 807,787 | 12/1905 | Staples | 52/465 |
| 905,469 | 12/1908 | Shuman | 52/417 |
| 1,144,332 | 6/1915 | Myers et al. | 52/469 |
| 1,342,802 | 6/1920 | Gerli et al. | 89/36.11 |
| 1,635,650 | 7/1927 | Tracy | 109/109 |
| 2,183,790 | 12/1939 | Dillehay et al. | 109/84 |
| 2,399,184 | 4/1946 | Heckert | 89/36.02 |
| 3,867,239 | 2/1975 | Alesi et al. | 428/911 |
| 4,075,386 | 2/1978 | Willdorf | 428/911 |

FOREIGN PATENT DOCUMENTS

| | | | |
|---|---|---|---|
| 90611 | 11/1895 | Fed. Rep. of Germany | 109/79 |
| 537587 | 6/1941 | United Kingdom | 52/469 |
| 2068830 | 8/1981 | United Kingdom | 428/911 |

*Primary Examiner*—Stephen C. Bentley
*Attorney, Agent, or Firm*—Herzig & Yanny

[57] ABSTRACT

Ballistic armor capable of meeting the threat of armor piercing projectiles of the type having a surface facing formed of individual elements and a backing capable of catching fragmented projectiles; the surface elements having gaps between them, the armor having a ballistic re-enforcing and deflecting strip secured to the armor over the said gaps, the strips being of hardened ballistic material and configurated to deflect the projectiles arriving at a predetermined degree of obliquity so as to force the projectiles to traverse a longer path through the armor.

5 Claims, 2 Drawing Sheets

COMPOSITE BALLISTIC ARMOR SYSTEM

This application is a continuation-in-part of the U.S. patent application entitled "Composite Ballistic Armor System", Ser. No. 424,130, filed by this applicant on 9/27/82 now abandoned.

BACKGROUND OF THE INVENTION

1. Field of the Invention

The present invention relates to an improved ballistic armor plate which consists of a facing of tiles and non-metallic backing typically applied in layers or plies. The invention is primarily concerned with improving the ballistic shielding quality of the armor.

2. Description of the Prior Art

Current investigations of prior art armor systems have uncovered important deficiencies in these prior art systems and have sought to achieve significant improvements in ballistic protection for many applications without significantly increasing the weight or cost for such systems.

There are military requirements for armor plate systems directed to maximize the protection against the .30 caliber armor piercing AP and .50 caliber (AP) threats. Various means are used to determine the effectiveness and degree of protection of such armor systems; however, the ultimate determination of acceptance of a system under these requirements requires a qualification test in which ballistic rounds are fired at different velocities at the armor until a critical impact velocity or ballistic limit of protection can be determined.

When armor tile and Kevlar composite armor systems are used for ballistic purposes, there is a gap line formed between the tile pieces where the pieces of tile are joined. Typically, there is less ballistic protection provided at this juncture. However, since it is impossible to know exactly where a bullet is going to impact the armor panel, it is necessary to minimize the chances that the bullet will penetrate the armor at the juncture.

Various attempts have been made which are focused at locally increasing the ballistic protection of armor systems at the joint line; means such as thickening of the juncture are often employed. The main considerations of these concepts are the ballistic protection provided, weight, and cost of fabrication. Such prior art concepts have left substantial room for improvement.

U.S. Pat. No. 316,250, by Douglas, discloses a steel strip for the joint lines between plates. The Douglas invention utilizes rivets to join the strip with the plates. The strip contains a single narrow ridge standing perpendicular to the plane of the plates. The strip provides the sole function of increasing the hard face material at the joint location, providing ballistic protection.

German Patentschrift No. 90611, by Hammeran, discloses two strips, each with a flat exterior face, one strip covering the joint line on one side of the juncture of two plates and the other covering the joint line on the other side of the juncture of the two plates. As in the Douglas patent these strips provide the sole function of increasing the hard face material at the joint location.

SUMMARY OF THE INVENTION

The present invention utilizes a joint line strip composed of a hard material which is adhered to the top of the joint with a polysulfide adhesive. In the embodiment reduced to practice that was ballistically tested, the material used for the joint line strip was composed of hardened steel. Other materials such as aluminum oxide, boron carbide, or silicon carbide casting can also be used for the joint line strip.

The basic function of the joint line strip is to increase the ballistic protection provided at the joints of the composite armor. This is done by increasing the hard face material at the joint location and by appropriately shaping the hard face material at the joint location resulting in deflection of the impacting projectile. Due to the unique shape of the joint line strip, bullets impacting at 0±5 degrees obliquity (the impact obliquity recently approved for all departments and agencies of the Department of Defense) are effectively deflected from their path normal to the armor and thereby forced to travel a longer path through the armor panel.

Simply increasing the thickness of the armor locally near the joint interface is quite expensive in that it requires special pieces to be made and fit together. The addition of a joint interface cover plate does increase the effective thickness of the joint; however, the bullet is not deflected by such a cover plate for increased ballistic protection, as is the case for the herein invention.

In the present applicant's above mentioned prior application, Ser. No. 424,130, a strip having a relatively pointed central ridge was disclosed. In that embodiment of the invention disclosed therein, the strip has a steep taper from the central ridge to deflect the bullet and to minimize the amount of material used. The configuration of the strip is dependent on the caliber of the projectile.

In investigations made subsequent to the filing of said prior application the inventor has discovered that although the pointed ridge strip is highly effective when the armor piercing round impacts at the centerline of this one inch strip, it is only marginally effective when armor piercing rounds impact the steel strip one quarter of an inch from the edge. This is caused be the rapid decay of the steel strip thickness from its centerline to the edge of the strip.

In order to overcome this deficiency, an alternate shape for the steel strip was developed, this shape is another embodiment of the invention and is another subject of the present application. This new configuration has the same cross sectional area, and consequently the same weight as the previous configuration, but provides for a better distribution of ballistic resistance from the joint line of the ceramic tile to the ½" line measured on either side of the joint line. The optimum shape of the cross section is within the parameters disclosed herein. The configuration of the improved strip is not dependent on the caliber of the projectile used.

Several backing materials can be utilized for the composite armor having tile facing such as:

(1) ¼" thick Aluminum Plate 2024 T351; (The numeral 2024 identifies the type of aluminum alloy and the character and numeral T351 identifies the degree of hardness.)

(2) Woven Roven Fiberglass with polyester resin 20–25% resin content by weight;

(3) Kevlar 49 or 29 woven roven, impregnated with polyester 20–25% resin content by weight.

The invention of the joint line strip basically incorporates the use of a hardened steel strip which is adhered directly to and over the interface of the tiles. The joint line strip, preferably is composed of ESR steel hardened to 61–64 as measured on the Rockwell C Scale. The calculated weight of one embodiment used in a series of ballistic tests was 0.157 pounds per linear foot. It is a relatively simple part to machine and can be cut to any desired lengths.

The invention ensures that the impregnability against ballistic threats of the sensitive joint line is maximized. An unmodified joint line is less capable of providing ballistic protection. MIL-A-46103C in fact allows a $V_{50}$ ballistic limit reduction of 5% at joint line locations. ($V_{50}$ is a test velocity figure at which half the projectiles penetrate the site and half do not.)

With the herein invention the strict requirements on tile joints is no longer necessary and the reduction of the allowable ballistic limit is not required. This is because a great deal of additional ballistic protection is provided by the presence of the strip of the instant invention. This also eliminates some of the associated manufacturing difficulties and reduces the cost of composite armor systems.

In the light of the foregoing, the primary object of the invention is to increase and enhance the ballistic efficiency and capability of composite ballistic armor of the type having a hard facing formed of individual elements such as tiles having a space or gap between the elements.

A further object is to improve the ballistic capability in composite armor as referred to in the foregoing by way of a ballistic re-enforcing and deflecting strip of hard material secured directly over the gap between elements; the strip of hardened material is configurated to be thickest at the area of the juncture.

A further object is to enhance the ballistic protection effectiveness further by providing a configuration of the strip which has a greater central thickness; this thickness provides a relatively pointed ridge positioned over the gap in order to break up and/or deflect an impacting projectile, causing the projectile or its fragments to travel through a greater thickness of the composite armor material.

A still further object is to enhance the ballistic protection effectiveness further by providing a configuration of the strip which has a greater central thickness; this thickness provides a flat central peak over the gap; this central peak has adjacent curved faces to cause the projectile or its fragments to be redirected so as to travel through a greater thickness of the composite armor material.

DETAILED DESCRIPTION AND BEST MODE OF PRACTICE

The invention involves locally stiffening the juncture of the tile interfaces; this has been found to be effective in increasing the ballistic protection particularly, but not limited thereto, for .30 caliber threats of composite armor plates. The invention consists of a joint line strip, composed of a relatively hard material whose function is to cause bullets which happen to impact at a joint line to be re-directed. The end result is that the limit of ballistic velocity is increased at the juncture locations—an especially weak area for composite ballistic armor.

Figure 1:
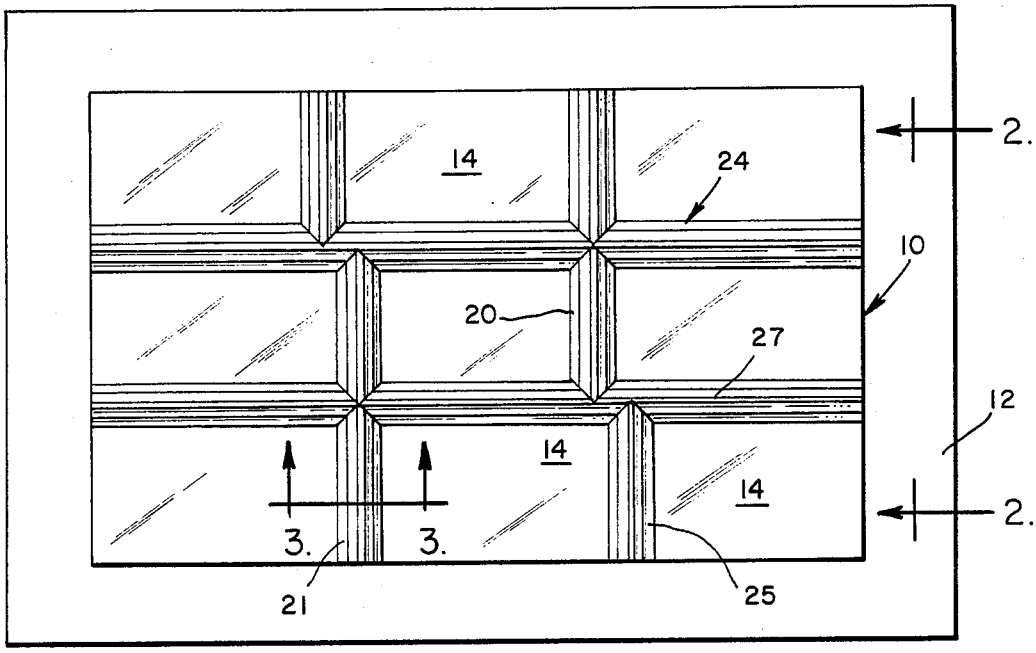
FIG. 1 is a plan view of a sheet of armor plate showing the ballistic reinforcements of the invention.

Referring to FIGS. 1 through 4 of the drawing these figures illustrate an armor test panel which was subjected to tests of its ballistic characteristics with reference to armor piercing projectiles which will be referred to presently. FIG. 1 shows the test panel generally designated as 10 in position for exposing it to the tests the panel being over a backing 12 which prevents projectile fragments which achieve complete penetration through the ceramic from continuing on their path.

The armor test panel itself as shown is a conventional panel of a type as referred to in the foregoing.

The facing of the panel is formed of individual ceramic tiles one of which is identified by the numeral 14, the tiles in the test panel being of known construction being ceramic, that is, aluminum oxide commercial grade.

Figure 3:
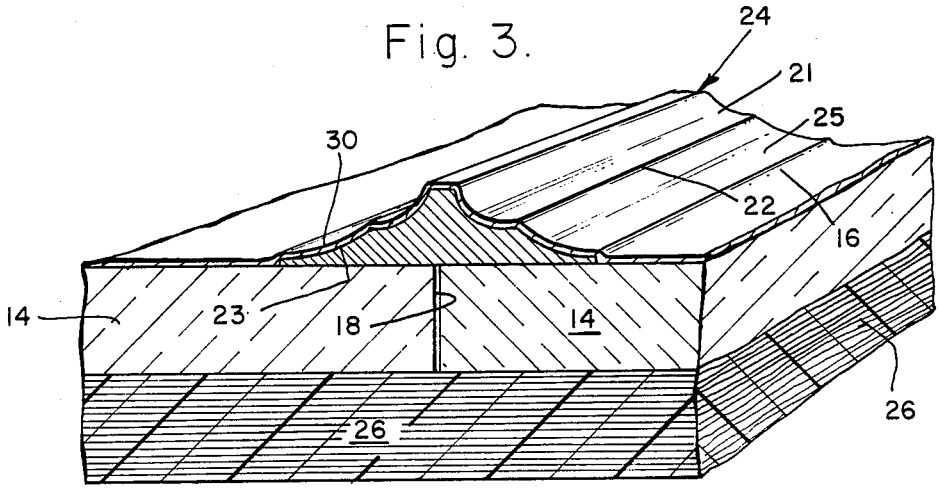
FIG. 3 is a sectioned isometric view illustrating the configuration of an idealized ballistic reinforcing strip.

As shown in FIG. 3, a juncture or gap 18 appears between the test panels; this gap being as conventionally appears between test panels in the conventional type of armor panel being described. This gap appears along the edges of all the panels, that is, at the joints between panels.

The cross sectional view of FIG. 3 shows the improved ballistic re-enforcing and deflecting strip 24 directly over the gap 18 between two of the tiles. In FIG. 1, the ballistic re-enforcing and deflecting strips are shown directly over the gaps between the tiles 14. The reference to a gap can be interpreted as a juncture, seam or the like also, or as a joint.

As pointed out, the armor test panel 10, aside from the strip 24, is of known construction, the tile facing panels having a backing of a number of plies of backing material, which as shown is Kevlar 29 which is known material in the construction of armor. The tile backing is designated by the numeral 26.

Figure 2:
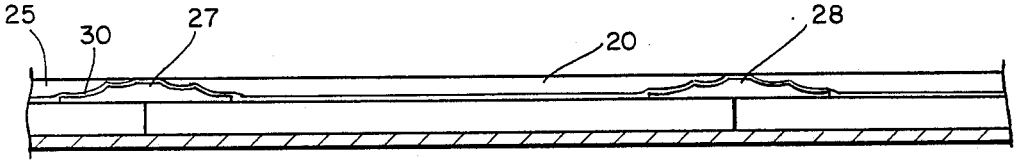
FIG. 2 is a sectional view taken along the line 2—2 of FIG. 1.

Two of the ballistic re-enforcing and deflecting strips running in a horizontal direction are identified at 27 and 28 in FIGS. 1 and 2. As may be seen, strips running at right angles to each other may cross at intersections of gaps between tiles.

In a preferred exemplary form of the invention the ballistic re-enforcing and deflecting strip is made of ESR steel hardened to 61–64 as measured on the Rockwell C scale. This material, that is, the steel itself is known in the art. The weight of the embodiment used in a series of ballistic tests made was 0.157 pounds per linear foot. It is a relatively simple part to machine and required lengths can be cut as desired.

Figure 4:
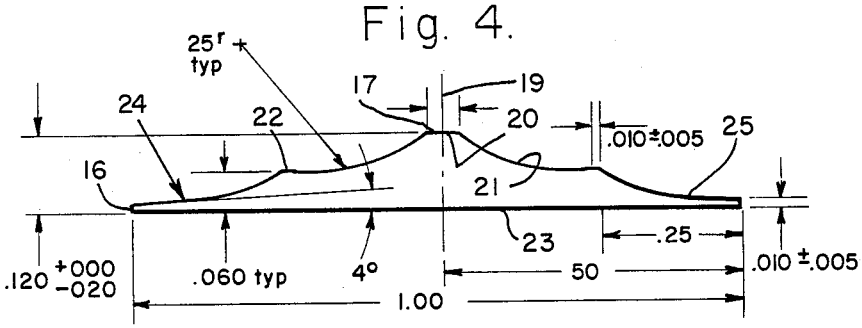
FIG. 4 is a cross sectional view of the ballistic reinforcing strip.

The configuration of the ballistic re-enforcing strip 24 is illustrated in FIGS. 3 and 4; as may be seen, the central part of the strip is configured as shown at 25 with the thickness diminishing toward the edges. Overlying the ballistic strip and the tiles is the spall shield 30 which is a known type of fabric material having the purpose of capturing fragments of disintegrated projectiles or other material.

FIG. 4 is a view illustrating the geometric shape of the improved ballistic re-enforcement strip 24 showing the dimensions of the particular strip.

The strip has a flat central peak 20 positioned over the gap line 18 with the length of 4/100 of that of the width of the strip and two inner contoured faces 21 symmetrically disposed about the center 19 and adjacent to the central peak. Each inner contoured face 21 has a bottom edge 22 at a location defined by the midpoint of a line extending from the center 17 of the central peak 20 to each respective edge 16 of the strip. The curvature of each inner contoured face 21 is defined by the arc created by a circle with a radius of 0.25 that of the width of the strip.

Two outer contoured faces 25 each adjacent to the bottom edge of an inner contoured face 21, are symmetrically disposed about the center line 19, and taper asymptotically from the ends 22 of the inner contoured faces 21 to the edges 16 of the strip 24. Each asymptote approaches an angle of 4 degrees in relation to the base 23 of the strip.

Figure 5:
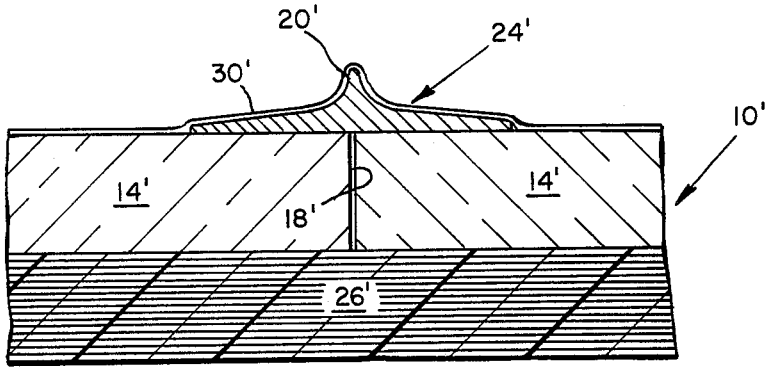
FIG. 5 is a cross sectional view of another embodiment of the ballistic reinforcing strip.
Figure 6:
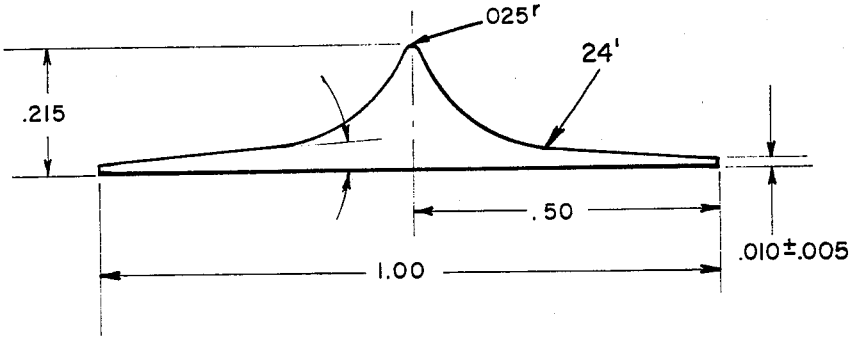
FIG. 6 is a schematic view illustrating the cross sectional dimensions of the idealized ballistic reinforcing strip of the embodiment of FIG. 5.

Another embodiment of the invention is illustrated in FIGS. 5 and 6. This embodiment is generally designated as 10'. The strip 24' has the same approximate weight and general dimensions as the strip generally designated as 24. However, strip 24' does not have the specific curvatures of strip 24.

The central part of the strip is configurated to be relatively pointed as shown at 20' with the thickness diminishing toward the edges. Overlying the ballistic strip and the tiles is the spall shield 30' which is a known type of material having the purpose of capturing fragments of disintegrated projectiles or other material, as in the other embodiment.

FIG. 6 is a view illustrating the geometric shape of the embodiment of the ballistic reinforcement strip 24' of FIG. 5 and showing the specific dimensions of that particular strip.

The re-enforcing ballistic strip 24 and 24' are secured to the tiles over the gaps 18 and 18' by way of an adhesive which may be preferably a polysulfide adhesive. The spall shields 30 and 30' are also secured by an adhesive.

The joint line strip serves to increase the ballistic protection provided at the joints of the composite armor. This is achieved by increasing the amount of hard face material at the joint location and by redirecting the impacting projectile by way of the particular configuration of the ballistic joint strip. Because of the unique shape of the strip the bullets impacting at 0±5 degrees obliquity are effectively redirected and thereby forced to travel a longer path through the armor panel.

The technology given is appropriate for .30 caliber armor piercing projectiles and also .50 caliber armor piercing projectiles. For larger armor piercing rounds the armor itself would be thicker and heavier; however, it can be manufactured in accordance with the geometrical relations given.

ACTUAL REDUCTION TO PRACTICE

In order to demonstrate the effectiveness of the improved joint strip concept, armor panels were fabricated with several identical joint line strips build into the armor system. Several panels were manufactured and tested by ARA, Inc. with ballistic results clearly demonstrating the new invention for defeating .30 caliber armor piercing rounds. Next, additional panels were manufactured by ARA, Inc. and were submitted to test by the U.S. Army, where .30 caliber armor piercing rounds were fired at the joint locations. A $V_{50}$ of over 2700 ft/sec was achieved on all portions of the improved joint line strip.

A second series of ballistic tests were conducted at a ballistic testing facility. The purpose of these tests was to provide data on the ballistic performance of the improved joint strips for the .50 caliber AP rounds at two levels of velocity—1200 ft/sec and 1600 ft/sec. Although an insufficient amount of ballistic testing was performed to determine a $V_{50}$, the tests demonstrated that the improved joint line strips work very well at both the 1200 ft/sec and 1600 ft/sec velocity requirements.

Comparable data was compiled for panels utilizing raised edges rather than the joint line strip. No complete penetrations were experienced when the joint line strip was used; however, for the raised edges a complete penetration was experienced at each of the two velocities. These series of tests clearly demonstrate the improved protection provided by the herein invention. The ballistic testing records showing where the shots were fired and proof of use of the firing ranges and relevant photographs were documented.

In the documentation, it is possible to examine the configuration of the joint line strip, the armor panel, and the tile/Kevlar composite materials of the panels used in the acutal ballistic testing.

It should be emphasized that other materials than those used in the ballistic testing identified herein can be used to make the joint line strip.

From the foregoing, those skilled in the art will readily understand the nature of the invention and the manner in which the objectives, as stated in the foregoing, are achieved.

The foregoing disclosure is representative of preferred forms of the invention and of a specific example of the invention and is to be interpreted in an illustrative rather than a limiting sense, the invention to be accorded the full scope of the claims appended hereto.

What is claimed is:

1. In a ballistic armor system having a hard surface facing formed of individual armor elements positioned to leave gaps between the elements, the armor system being a composite having backing behind the hard surface facing comprised of a material capable of receiving the fragments of projectiles that penetrate the hard surface facing, the system comprising a strip of hardened material secured to adjacent armor elements over the gaps, said strip having a larger thickness in the area over the gaps than in the area at the edges of the gaps whereby said strip deflects an impacting projectile to cause a directional change whereby the projectile is forced to traverse a greater thickness of armor than would be traversed in a projectile path normal to the armor;

said strip having a central peak positioned substantially over the gaps, two inner contoured faces symmetrically disposed laterally adjacent said central peak with upper edges defining said central peak, and two outer contoured faces symmetrically disposed about the central peak with upper edges adjacent to the lower edges of said inner contoured faces wherein the bottom edges of said inner contoured faces have slopes less steep than the upper edges of said outer contoured faces; and said inner contoured faces have curvatures defined by the arc of a circle having a radius of 0.25 of the total width of the strip, said inner contoured faces having edges at the locations defined by the mid points of lines extending from the center of the central peak to the edges of the strip, said outer contoured faces each tapering asymptotically from the respective bottom edge of each inner contoured face, each asymptote approaching an angle of 4 degrees.

2. In a ballistic armor system having individual armor tile elements disposed laterally adjacent each other to provide a hard armor facing, the armor system including a backing disposed behind the hard armor facing, the backing being composed of a material capable of receiving the projectile fragments which penetrate the hard facing, comprising: a strip of hardened material secured to adjacent tile elements over the juncture thereof, said strip having a central peak projecting from the tile elements at the juncture a distance a, said strip having intermediate peaks laterally positioned to said central peak, said intermediate peaks projecting from the tile elements a distance b, said strip having a lateral edges projecting from the tile elements a distance c, said intermediate peaks disposed a distance d from proximal said lateral edges, said central peak having a width e, each of said intermediate peaks having a width f, said strip having a width g, said strip, said central peak and said lateral edges being so proportioned that the following relationships are true: a is approximately equal to 0.120 g, b is approximately equal to 0.060 g, c is approximately equal to 0.010 g, d is approximately equal to 0.25 g, e is approximately equal to 0.040 g, f is approximately equal to 0.010 g.

3. An armor system as in claim 2, wherein said strip has two inner contoured faces symmetrically disposed and extending the length of said strip, said inner contoured faces having upper edges defining said central peak, said inner contoured faces having lower edges, said strip having outer contoured faces symmetrically disposed and extending the length of said strip, said outer contoured faces having upper edges, said lower edges of said inner faces and said upper edges of said outer faces defining said intermediate peaks, said inner contoured faces having a radius of curvature approximately equal to 0.25 g.

4. An armor system as in claim 3, wherein each of said outer contoured faces have an asymptote inclined at an angle of approximately 4 degrees relative to the tile elements.

5. An armor system as in claim 3, wherein said strip includes steel having a hardness within the range of 61–64 on the Rockwell C scale.

* * * * *